United States Patent [19]

Tsubokawa

[11] Patent Number: 4,675,950

[45] Date of Patent: Jun. 30, 1987

[54] SLIDE FASTENER SUITABLE FOR USE ON ARTICLES MADE OF PLASTICS MATERIAL

[75] Inventor: Yoshitoki Tsubokawa, Kurobe, Japan

[73] Assignee: Yoshida Kogyo K.K., Tokyo, Japan

[21] Appl. No.: 853,699

[22] Filed: Apr. 18, 1986

[30] Foreign Application Priority Data

Apr. 19, 1985 [JP] Japan ..... 60-59447[U]

[51] Int. Cl.[4] ..... A44B 19/40

[52] U.S. Cl. ..... 24/390; 24/392

[58] Field of Search ..... 24/390, 389, 387, 392, 24/393

[56] References Cited

U.S. PATENT DOCUMENTS

| | | | |
|---|---|---|---|
| 3,005,247 | 10/1961 | Doelter | 24/389 |
| 3,487,510 | 1/1970 | Frohlich | 24/393 |
| 3,487,511 | 1/1970 | Frohlich | 24/392 |
| 3,624,871 | 12/1971 | Osterkorn | 24/389 |
| 4,126,158 | 11/1978 | Scott | 24/392 |
| 4,216,805 | 8/1980 | Akashi | 24/392 |
| 4,304,030 | 12/1981 | Yoshida | 24/392 |
| 4,312,102 | 1/1982 | Fukuroi | 24/389 |
| 4,510,656 | 4/1985 | Yoshida et al. | 24/390 |

FOREIGN PATENT DOCUMENTS

| | | | |
|---|---|---|---|
| 2626663 | 12/1977 | Fed. Rep. of Germany | 24/392 |

*Primary Examiner*—Victor N. Sakran

*Attorney, Agent, or Firm*—Hill, Van Santen, Steadman & Simpson

[57] ABSTRACT

A slide fastener suitable for use on an article made of a plastics material comprises a pair of stringer tapes each including an element-supporting portion formed of a woven or knit fabric, supporting on and along its one longitudinal edge a row of coupling elements and disposed in confronting relation to a guide flange of a slider, and a web portion made of a plastics material and joined with the element-supporting portion for the attachment to the plastic article. Such combination of the fabric element-supporting portion with the plastic web portion provides prolonged service life of the slide fastener without being affected by changing ambient temperature.

20 Claims, 10 Drawing Figures

SLIDE FASTENER SUITABLE FOR USE ON ARTICLES MADE OF PLASTICS MATERIAL

BACKGROUND OF THE INVENTION

1. Field of the Invention:

This invention relates to slide fasteners, more particularly to such a slide fastener which is suitable for use on rain coats, windbreakers, cushion covers and other articles that are made of a plastics material.

2. Prior Art:

There are known slide fasteners which comprise a pair of support tapes each carrying along one of their longitudinal edges a row of coupling elements, the support tape being made of a sheet of plastics material which can be attached by means of ultrasonic or high-frequency welding to a given article made of similar plastics material. Difficulties were encountered however with the way of securing the coupling elements to such thread-free plastic tape. When this was done by sewing stitches, the needle holes would often become widened and ruptured, causing the tape to tear apart under the influence of transverse tension. To overcome this difficulty, it has been proposed to reinforce the plastic tape with a strip of woven fabric such as taffeta extending over one or the other side along the longitudinal edge of the tape to which the coupling elements are secured. This prior art proposal however has a drawback in that the reciprocal movement of the slider to open or close the fastener becomes sluggish or otherwise difficult on account of dimensional changes in the plastic tape with changing ambient temperature. Performance tests further indicate that when stress, particularly transverse tension, is applied, the tape tends to get torn along its edge portion that confronts the side flanges of the slider, thus rendering the fastener inoperative under severe conditions. It was also found difficult during the assembling of fasteners with component parts, sliders in particular, to thread these sliders through the stringers because the tapes would often get warped and so deformed due to change in the environmental temperature.

SUMMARY OF THE INVENTION

It is a principal object of the present invention to overcome the foregoing difficulties of the prior art.

A more specific object of the present invention is to provide a slide fastener including a pair of opposed stringer tapes having structural features which enable easy attachment of the slide fastener to an article made of a plastics material and provide prolonged service life of the slide fastener without being affected by changing ambient temperature.

According to the present invention, a slide fastener comprises a pair of stringer tapes each of which includes an element-supporting portion made of a fibrous material, supporting on and along one of its opposite longitudinal edges a row of coupling elements, and disposed in confronting relation to a guide flange of a slider, and a web portion made of a plastics material and joined with the element-supporting portion for attachment to an article made of a plastics material.

The above and other objects and features of the present invention will be better understood from the following description of some embodiments taken in conjunction with the accompanying drawings.

DETAILED DESCRIPTION

Like numerals refer to like or corresponding parts throughout the several views.

Figure 1:
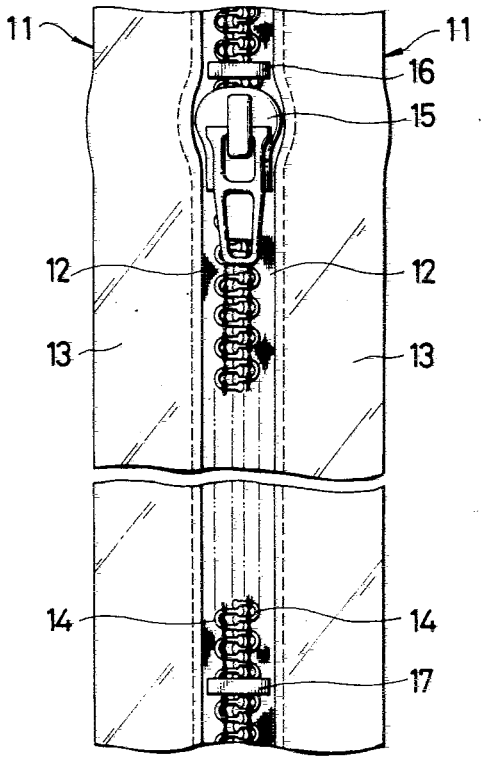
FIG. 1 a plan view of a general construction of a slide fastener provided in accordance with the present invention.

As shown in FIG. 1, a slide fastener comprises a pair of stringer tapes 11, 11 each including an element-supporting portion 12 formed of a fibrous thread system and a web portion 13 formed of a sheet of plastic material, the portions 12, 13 being joined together along one longitudinal edge thereof. A pair of opposed rows of coupling elements 14, 14 of a meander or zig-zag formation is secured by a pair of sewn seams (not designated) to and along confronting inner longitudinal edges or margins of the respective element-supporting portions 12, 12 of the stringer tapes. A slider 15 is slidably mounted on the rows of coupling elements 14, 14 and is reciprocable between two remotely disposed end stops 16, 17 to take the rows of coupling elements into and out of interdigitating engagement with each other as is well know in the art.

Figure 2:
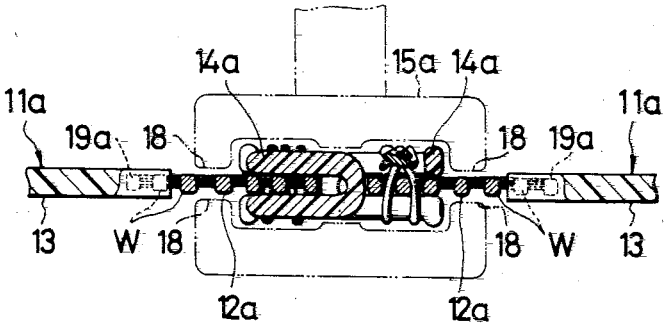
FIG. 2 is an enlarged fragmentary transverse cross-sectional view, partly in end elevation, of a slide fastener according to an embodiment of the invention.

FIG. 2 shows a specific embodiment of the invention in which each stringer tape **11*a* comprises an element-supporting portion 12*a* carrying on and along its inner longitudinal edge a row of zig-zag coupling elements 14*a* and disposed in confronting relation to one of two guide flanges 18 of a slider 15*a*, and a web portion 13 formed of a sheet of plastics material such as vinyl chloride. The element-supporting portion 12*a* is formed of a warp-knit fabric having a waled-face on one side of the element-supporting portion 12*a*, the waled-face fabric including having a plurality (seven in the illustrated embodiment) of wales W. The element-supporting portion 12*a* has a connecting section 19*a* extending along its outer longitudinal edge and including at least one, preferably more than two wales W. The connecting section 19*a* is anchored in place centrally within the web portion 13. This anchoring may be done for example by extruding the plastics material constituting the web portion 13 over the connecting section 19*a* of the element-supporting portion 12*a***.

Figure 3:
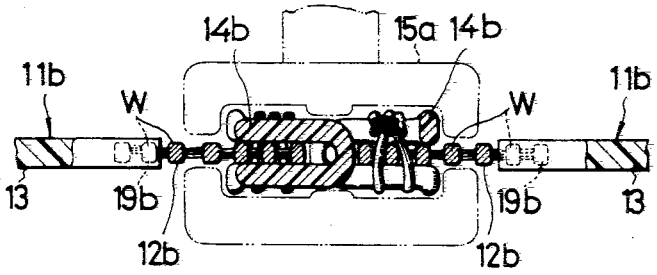
FIGS. 3 through 5 are views similar to FIG. 2, respectively showing different embodiments.

FIG. 3 shows another specific embodiment which is idential with that of FIG. 2 with the exception that an element supporting portion **12*b*** of each stringer tape 11*b* is formed of a warp-knit fabric having a waled-face including a plurality of wales W, on each side of the element-supporting portion 12*b*.

Figure 4:
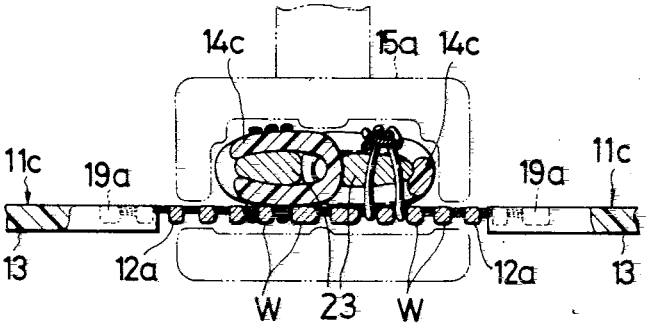

FIG. 4 shows a further embodiment which is similar to that of FIG. 2, except that a row of coupling elements 14*c* is in the form of a helical coil mounted on and secured through a core cord 23 to each element-supporting portion 12*a* and that the connecting section 19*a* is embodied within the web portion 13 but is located off the center of the thickness of the web portion 13.

Figure 5:
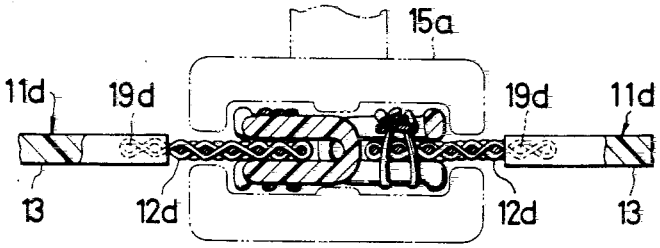

FIG. 5 shows still another embodiment of the invention in which a stringer tape 11*d* has an element-supporting portion 12*d* formed of a woven fabric. The woven element-supporting portion 12*d* is embedded in a web portion 13 along its connecting portion 19*d*.

Figure 6:
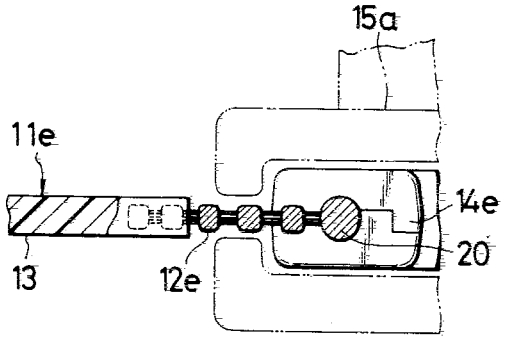
FIG. 6 is an enlarged fragmentary transverse cross-sectional view, partly in end elevation, of one of identical halves of a slide fastener according to still another embodiment of the invention.

FIG. 6 shows a still further embodiment in which each stringer tape 11*e* has a warp-knit element-supporting portion 12*e* similar to that shown in FIG. 3 and which features the provision of an enlarged bulb-like protuberance 20 at the innermost edge of the element-supporting portion 12*e*. A row of coupling elements 14*e* of synthetic resin is injection-molded around the protuberance 20.

Figure 7:
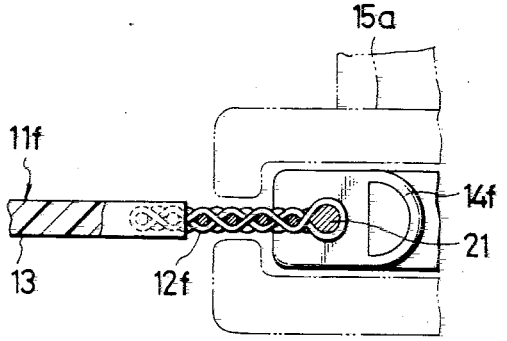
FIG 7 is a view similar to FIG. 6 but showing a still further embodiment.

FIG. 7 shows another embodiment of the invention in which each stringer tape 11*f* includes a woven element-supporting portion 12*f* having an enlarged bulb-like protuberance 21 at the innermost edge of the element-supporting portion 12*f*, the protuberance 21 supporting a row of metallic coupling elements 14*f* molded on or clinched to the protuberance 21.

Figure 8:
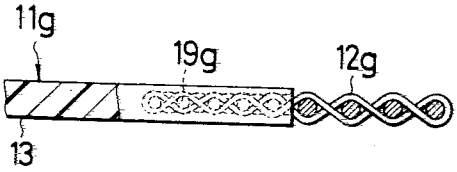
FIG. 8 is an enlarged fragmentary transverse cross-sectional view, partly in end elevation, of a tape portion of a fastener according to another embodiment with coupling elements and a slider being omitted for clarity.

FIG. 8 shows a modification of a stringer tape 11*g* according to the invention. The stringer tape 11*g* includes an element-supporting portion 12*g* of a woven fabric, the thickness of which is substantially the same as that of the web portion 13, excepting that a connecting section 19*g* is reduced in thickness to be fully embedded in the web portion 13. To make such thickened element-supporting portion 12*g*, thicker threads may be employed.

Figure 9:
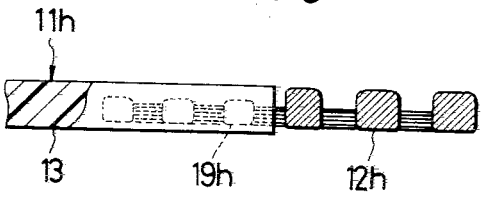
FIG. 9 is a view similar to FIG. 8 but showing a further embodiment of the invention.

Another modification shown in FIG. 9 is substantially the same in principle as that of FIG. 8 except that the element-supporting portion 12*h* is formed of a warp-knit fabric.

Figure 10:
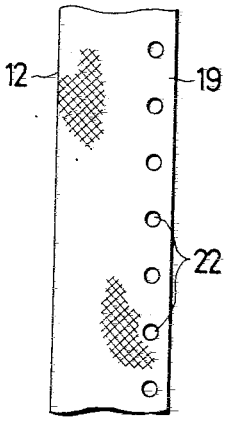
FIG. 10 is a fragmentary plan view of a part of a stringer tape having perforations along one of its longitudinal edges.

Throughout all of the illustrated embodiments, the connecting section of the element-supporting portion 12, which is either knitted or woven with fibrous material, is anchored within the web portion 13 by means of the plastics material of the web portion 13 which melts and penetrates into the interstices of the fibrous threads of the connecting section. To enhance this anchoring effect, the element-supporting portion 12 may be perforated at suitable intervals along the connecting section 19 by ultrasonic or high-frequency processing as shown in FIG. 10, the resulting perforations 22 being filled with hot melt plastics material, thereby securing the connecting section 19 to the web portion 13.

The slide fastener of the foregoing construction is suitable for use on a variety of articles made of a plastics material as the web portion 13 may be attached thereto conveniently by ultrasonic or high-frequency welding.

The combination of the element-supportion portion 12, 12*a*–12*h* made of a fibrous thread system and the web portion 13 made of a plastics material provides prolonged service life of the slide fastener without being affected by changing ambient temperature and thus eliminates the various drawbacks of the prior art noted at the outset of this specification.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A slide fastener comprising a pair of stringer tapes carrying on and along their inner longitudinal edges a pair of rows of coupling elements; a slider slidably mounted on and reciprocable along said rows of coupling elements to take them into and out of interdigitating engagement with each other said slider having a pair of guide flanges along its opposite side edges; and each of said stringer tapes including an element-supporting portion being made of a fibrous material and supporting on an along one of its opposite longitudinal edges a corresponding one of said rows of coupling elements which are disposed in confronting relation to one of said guide flanges of said slider, said element-supporting portion having a connecting section extending along the other longitudinal edge thereof with a number of perforations define in and along said connecting section at suitable intervals, and a web portion for attachment of the tape to an article, said web portion being made of a plastics material and being joined with said element-supporting portion by the connecting portion being embedded in the web portion and plastic material of the web portion filling said perforations.

2. A slide fastener according to claim 1, said connecting section being disposed centrally within said web portion.

3. A slide fastener according to claim 1, said connecting section being disposed off the center of the thickness of said web portion.

4. A slide fastener according to claim 1, said element-supporting portion having a thickness substantially the same as the thickness of said web portion, except lesser at its connecting section.

5. A slide fastener according to claim 1, said element-supporting portion being formed of a warp-knit fabric.

6. A slide fastener according to claim 5, said warp-knit element-supporting portion having a waled-face on only one of its opposite sides.

7. A slide fastener according to claim 5, said warp-knit element-supporting portion having a waled-face on each of its opposite sides.

8. A slide fastener according to claim 1, said element-supporting portion being formed of a woven fabric.

9. A slide fastener according to claim 1, said element-supporting portion having an enlarged bulb-like protuberance at said one longitudinal edge therof.

10. A slide fastener according to claim 1, said element-supporting portion having throughout its entire width a uniform thickness.

11. A slide fastener comprising a pair of stringer tapes carrying on and along their inner longitudinal edges a pair of rows of coupling elements; a slider slidably mounted on and reciprocable along said rows of coupling elements to take them into and out of interdigitating engagement with each other, said slider having a pair of guide flanges along its opposite side edges; and each of said stringer tapes including an element-supporting portion made of a fibrous material and supporting on and along one of its opposite longitudinal edges a corresponding one of said rows of coupling elements, which are disposed in confronting relation to one of said guide flanges of said slider, and a web portion made of a plastics material and joined along one of its opposite longitudinal edges with the opposite longitudinal edge of said element-supporting portion for attachment of the tape to an article, said element-supporting portion having an integral connecting section extending along said other longitudinal edge thereof and being embedded in said web portion for joining the supporting portion to the web portion.

12. A slide fastener according to claim 11, said connecting section being disposed centrally within said web portion.

13. A slide fastener according to claim 11, said connecting section being disposed off the center of the thickness of said web portion.

14. A slide fastener according to claim 11, said element-supporting portion having a thickness substantially the same as the thickness of said web portion, except lesser at its connecting section.

15. A slide fastener according to claim 11, said element-supporting portion being formed of a warp-knit fabric.

16. A slide fastener according to claim 15, said warp-knit element-supporting portion having a waled-face on only one of its opposite sides.

17. A slide fastener according to claim 15, said warp-knit element-supporting portion having a waled-face on each of its opposite sides.

18. A slide fastener according to claim 11, said element-supporting portion being formed of a woven fabric.

19. A slide fastener according to claim 11, said element-supporting portion having an enlarged bulb-like protuberance at said one longitudinal edge thereof.

20. A slide fastener according to claim 11, said element-supporting portion having throughout its entire width a uniform thickness.

* * * * *